US012504010B2

(12) United States Patent
Sorkin

(10) Patent No.: US 12,504,010 B2
(45) Date of Patent: Dec. 23, 2025

(54) HEAT EXCHANGER FOR HYDRAULIC POST-TENSIONING JACK SYSTEM

(71) Applicant: Felix Sorkin, Stafford, TX (US)

(72) Inventor: Felix Sorkin, Stafford, TX (US)

( * ) Notice: Subject to any disclaimer, the term of this patent is extended or adjusted under 35 U.S.C. 154(b) by 0 days.

(21) Appl. No.: 18/970,700

(22) Filed: Dec. 5, 2024

(65) Prior Publication Data

US 2025/0180011 A1 Jun. 5, 2025

Related U.S. Application Data

(60) Provisional application No. 63/606,388, filed on Dec. 5, 2023, provisional application No. 63/691,101, filed on Sep. 5, 2024, provisional application No. 63/557,821, filed on Feb. 26, 2024.

(51) Int. Cl.
*F04B 53/08* (2006.01)
*F04B 17/03* (2006.01)
*F04C 29/04* (2006.01)

(52) U.S. Cl.
CPC ..... *F04B 53/08* (2013.01); *F04B 17/03* (2013.01); *F04C 29/04* (2013.01); *F04B 2205/10* (2013.01); *F04B 2205/11* (2013.01); *F04C 2270/19* (2013.01); *F04C 2270/195* (2013.01)

(58) Field of Classification Search
CPC ..... F04B 17/03; F04B 53/08; F04B 2205/10; F04B 2205/11; F04C 29/04; F04C 2270/19; F04C 2270/195; F04D 29/586; F04D 29/5866
USPC ..... 417/373
See application file for complete search history.

(56) References Cited

U.S. PATENT DOCUMENTS 3,090,598 A 5/1963 Odilo
3,176,961 A 4/1965 Glass
3,666,375 A * 5/1972 Priest et al. ..... F04D 29/108 277/408
3,703,030 A 11/1972 Simms
3,785,617 A 1/1974 Friedrich
3,811,653 A 5/1974 Persicke
3,902,698 A 9/1975 Furrer
3,954,005 A 5/1976 Edwards
4,106,752 A 8/1978 Roqueta
(Continued)

FOREIGN PATENT DOCUMENTS

EP 0665379 A1 8/1995
GB 998313 A * 7/1965

OTHER PUBLICATIONS

International Search Report and Written Opinion dated Feb. 14, 2025 received in PCT/US2024/058666, 12 pages.

*Primary Examiner* — Charles G Freay
(74) *Attorney, Agent, or Firm* — HUNTON ANDREWS KURTH LLP

(57) ABSTRACT

The present disclosure relates to an improved hydraulic pump for maintaining acceptable operating temperatures for hydraulic fluid used in a post-tensioning jack system for post-tensioning concrete. Embodiments include a pump unit with a fan and a heat exchanger. The heat exchanger may be located directly below the motor for the pump and a fan unit; other embodiments include a heat exchanger may be located on a side of the pump with a co-located fan unit. The pump unit may be portable and battery powered. The pump unit may include a digital display for input and output of operating parameters.

12 Claims, 23 Drawing Sheets

(56) References Cited

U.S. PATENT DOCUMENTS

| | | | | |
|---|---|---|---|---|
| 4,110,643 | A | 8/1978 | Muller | |
| 4,186,169 | A | 1/1980 | Black | |
| 4,302,978 | A | 12/1981 | Dykmans | |
| 4,302,979 | A | 12/1981 | Dykmans | |
| 4,746,096 | A | 5/1988 | Donnell | |
| 4,805,877 | A | 2/1989 | Hoekstra | |
| 4,862,576 | A | 9/1989 | Lu | |
| 5,342,568 | A | 8/1994 | Yokota | |
| 5,452,629 | A | 9/1995 | Heiermann | |
| 6,070,314 | A | 6/2000 | Pithan | |
| 6,224,036 | B1 | 5/2001 | Prince | |
| 6,290,473 | B1 | 9/2001 | Thome et al. | |
| 6,318,038 | B1 | 11/2001 | Park | |
| 6,328,541 | B1 * | 12/2001 | Veronesi | F04D 29/5866 376/404 |
| 6,470,636 | B1 | 10/2002 | Rose | |
| 6,739,129 | B2 * | 5/2004 | Heusser | F15B 11/028 91/437 |
| 6,848,323 | B2 | 2/2005 | Krauth | |
| 7,147,210 | B2 | 12/2006 | Foege | |
| 8,152,458 | B2 * | 4/2012 | Buell | F04D 29/043 417/373 |
| 8,702,066 | B2 | 4/2014 | Steidinger et al. | |
| 9,103,131 | B2 | 8/2015 | Damage | |
| 9,506,492 | B2 | 11/2016 | Trautman | |
| 10,203,268 | B2 | 2/2019 | Parker | |
| 10,281,270 | B2 | 5/2019 | Smith | |
| 10,364,816 | B2 | 7/2019 | Nofal et al. | |
| 10,400,801 | B2 * | 9/2019 | Boehler | F04B 17/06 |
| 10,830,655 | B2 | 11/2020 | Cook | |
| 10,844,619 | B2 | 11/2020 | Kang | |
| 11,162,482 | B2 | 11/2021 | Dawson et al. | |
| 2007/0271762 | A1 | 11/2007 | Hohensee | |
| 2014/0016114 | A1 | 1/2014 | Lopez | |
| 2016/0333902 | A1 | 11/2016 | Hodel | |
| 2017/0217026 | A1 | 8/2017 | Sipe | |
| 2017/0356438 | A1 * | 12/2017 | Hughes | F04B 39/06 |
| 2018/0106041 | A1 | 4/2018 | Sorkin | |
| 2018/0335024 | A1 * | 11/2018 | Hughes | F04B 17/06 |
| 2020/0173430 | A1 | 6/2020 | Hughes et al. | |
| 2021/0277912 | A1 * | 9/2021 | Sinico | F04D 29/007 |

* cited by examiner

100

200

HEAT EXCHANGER FOR HYDRAULIC POST-TENSIONING JACK SYSTEM

RELATED APPLICATIONS

This application claims priority to U.S. Provisional Application 63/606,388, entitled "Heat Exchanger for Hydraulic Post-Tensioning Jack System," filed on Dec. 5, 2023, U.S. Provisional Application 63/691,101, entitled "Hydraulic Pump with Integrated Cooling," filed on Sep. 5, 2024, and U.S. Provisional Application 63/557,821, entitled "Battery Operated Hydraulic Pump and Method for Using Same." filed on Feb. 26, 2024. The contents of these priority applications are incorporated by reference herein in their entirety.

FIELD OF THE DISCLOSURE

The present disclosure relates to post-tensioning concrete, and more specifically, a device for maintaining acceptable operating temperatures for hydraulic fluid used in a post-tensioning jack system.

BACKGROUND AND SUMMARY

Many structures are built using concrete, including, for instance, buildings, parking structures, apartments, condominiums, hotels, mixed-use structures, casinos, hospitals, medical buildings, government buildings, research/academic institutions, industrial buildings, malls, bridges, pavement, tanks, reservoirs, silos, foundations, sports courts, and other structures.

Pre-stressed concrete is structural concrete in which internal stresses are introduced to reduce potential tensile stresses in the concrete resulting from applied loads. Pre-stressing may be accomplished by post-tensioned pre-stressing or pre-tensioned pre-stressing. In post-tensioned pre-stressing, a tension member is tensioned after the concrete has attained a desired strength by use of a post-tensioning tendon. The post-tensioning tendon may include for example and without limitation, anchor assemblies, the tension member, and sheathes.

Traditionally, a tension member is constructed of a material that can be elongated and may be a single or a multi-strand cable. The tension member may be formed from a metal, such as reinforced steel. The post-tensioning tendon traditionally includes an anchor assembly at each end. The tension member is fixedly coupled to a fixed anchor assembly positioned at one end of the post-tensioning tendon, the "fixed end," and stressed at the stressed anchor assembly positioned at the opposite end of the post-tensioning tendon, the "stressing end" of the post-tensioning tendon.

In a typical tendon tensioning anchor assembly in post-tensioning operations, there are provided anchors for anchoring the ends of the cables suspended therebetween. In the course of installing the cable tensioning anchor assembly in a concrete structure, a hydraulic jack or the like is releasably attached to one of the exposed ends of cable (the stressing end) for applying a predetermined amount of tension to the tendon. When the desired amount of tension is applied to the cable, wedges, threaded nuts, or the like, are used to capture the cable and, as the jack is removed from the tendon, to prevent its relaxation and hold it in its stressed condition.

Post-tensioning hydraulic jacking systems generally consist of the jack assembly (or stressing jack), hydraulic lines, and a hydraulic pump. Examples of components for an existing jacking system are illustrated in FIG. 1A (jack assembly 10) and FIG. 1B (hydraulic pump 20). The hydraulic pump includes an axial piston pump element and electric motor. Typical systems also include hydraulic tendon cutters.

However, in operation, hydraulic systems, such as the jacking system described above, need coolers. Hydraulic fluid becomes heated as it is used to activate hydraulic jacks (and/or hydraulic tendon cutters). Specifically, the hydraulic fluid or oil needs to be cooled to remove heat that builds up in use. Lubrication and power transmission depend on the right fluid viscosity. The viscosity changes after a certain temperature point, which depends on a fluid's viscosity grade and viscosity index. Heat can damage the fluid as well as damage components. Thus, heat exchange (e.g., cooling) for the hydraulic fluid is important.

Traditionally, the hydraulic fluid may maintain an acceptable working temperature by ensuring a large enough fluid reservoir in the pump so as to dissipate heat generated from the operation of the hydraulic system. In hydraulic systems, different types of heat exchangers (e.g., hydraulic oil coolers) are used. All work by facilitating heat transfer from the fluid to a cooling medium because of temperature difference. Typical cooling mediums include air, water, or even hydraulic fluid or oil. These heat exchangers are typically located external to the hydraulic pump. Further, many hydraulic pumps require an external power source, limiting portability of the hydraulic pump.

These and other deficiencies exist.

SUMMARY

Exemplary embodiments include a hydraulic pump unit having a hydraulic pump with integrated cooling that includes a coil and a fan. Further, the hydraulic pump unit according to exemplary embodiments may be battery powered and portable. The hydraulic pump unit may include a display screen.

Exemplary embodiments include a hydraulic pump unit having a hydraulic pump with a fan, powered by an electric motor mechanically coupled via a shaft to the fan and the hydraulic pump to provide motive force to the fan and the hydraulic pump and having a cooling coil located directly beneath the fan and over the hydraulic pump and that is fluidly coupled to the hydraulic pump to allow for hydraulic fluid to flow through and exchange heat with the atmosphere.

Exemplary embodiments include a hydraulic pump unit having a hydraulic pump, a heat exchanger unit having a fan and a cooling coil configured to allow for hydraulic fluid to flow through and exchange heat with the atmosphere. Further, the heat exchanger unit is located on a side of the hydraulic pump. The hydraulic pump unit may be portable.

BRIEF DESCRIPTION OF THE DRAWINGS

Various embodiments of the present disclosure, together with further objects and advantages, may best be understood by reference to the following description taken in conjunction with the accompanying drawings.

These and other objects, features and advantages of the exemplary embodiments of the present disclosure will become apparent upon reading the following detailed description of the exemplary embodiments of the present disclosure, when taken in conjunction with the appended paragraphs.

DETAILED DESCRIPTION

Exemplary embodiments of the invention will now be described in order to illustrate various features of the invention. The embodiments described herein are not intended to be limiting as to the scope of the invention, but rather are intended to provide examples of the components, use, and operation of the invention.

Figure 1B:
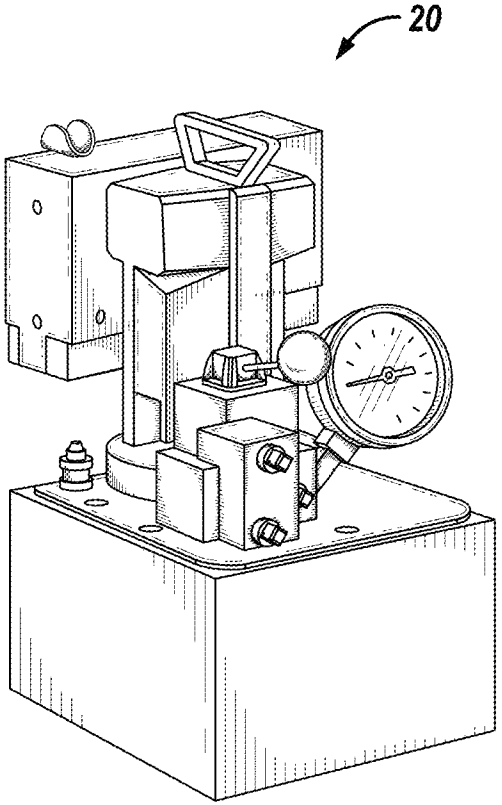
FIG. 1B (Prior Art
FIGS. 1A and 1B shows an example of a prior art jack assembly and a hydraulic pump.
Figure 1A:
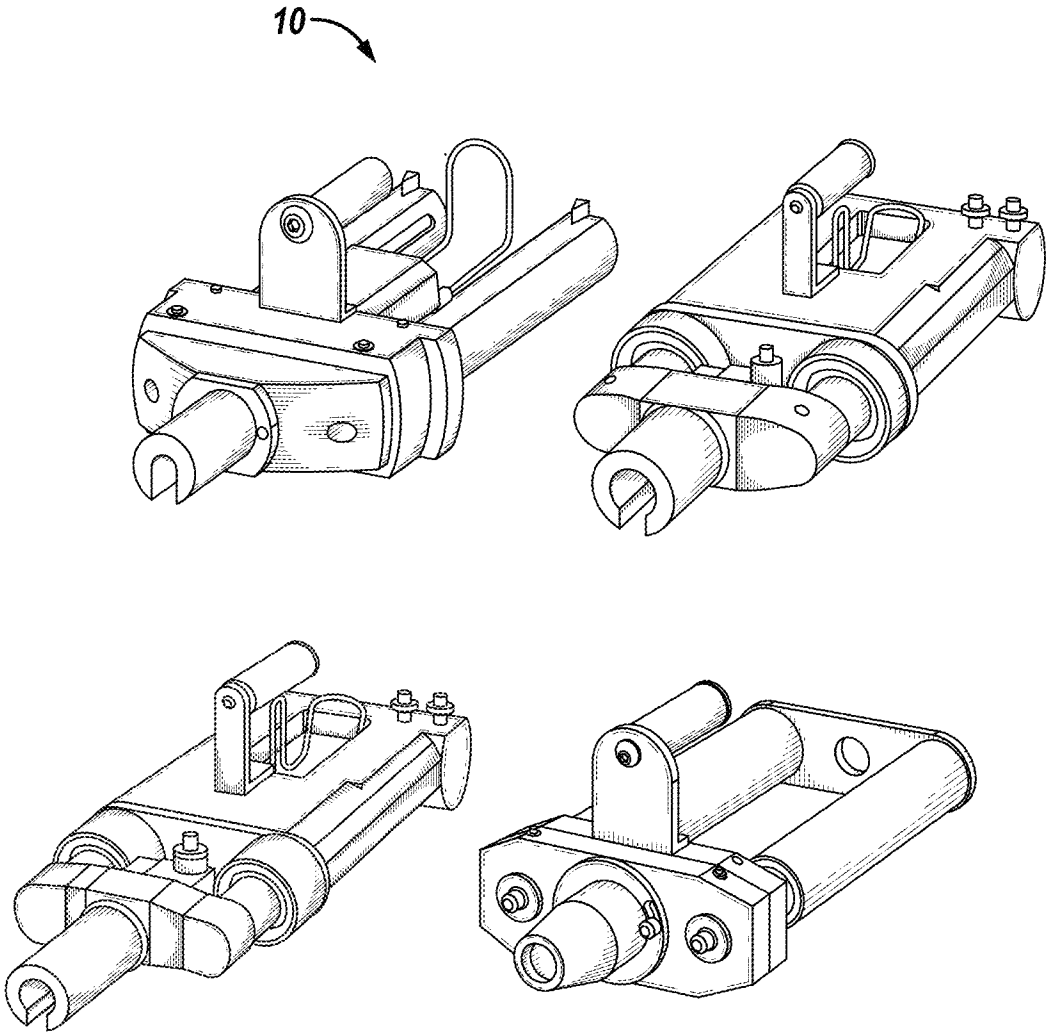
FIG. 1A (Prior Art)
Figure 2:
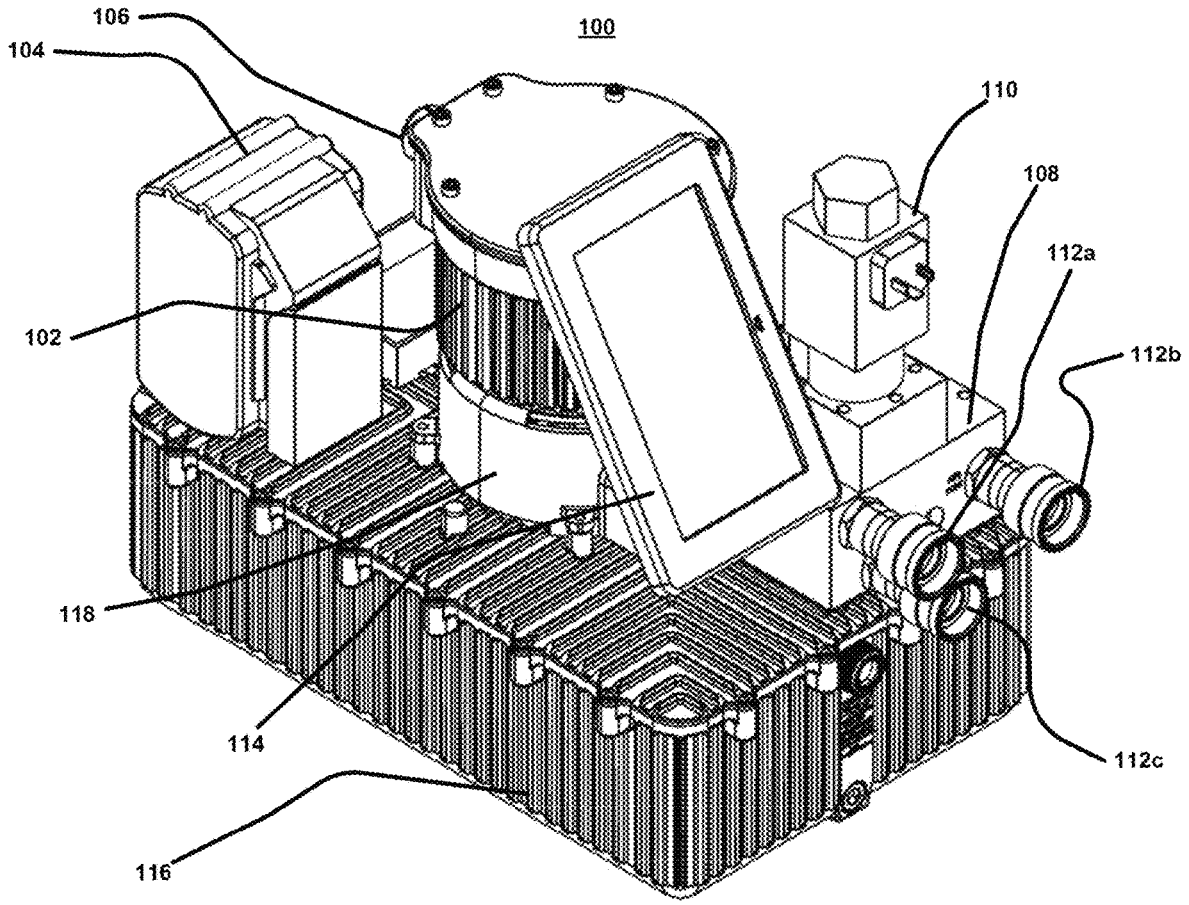
FIG. 2 is a top perspective view of a pump unit according to exemplary embodiments.
Figure 3:
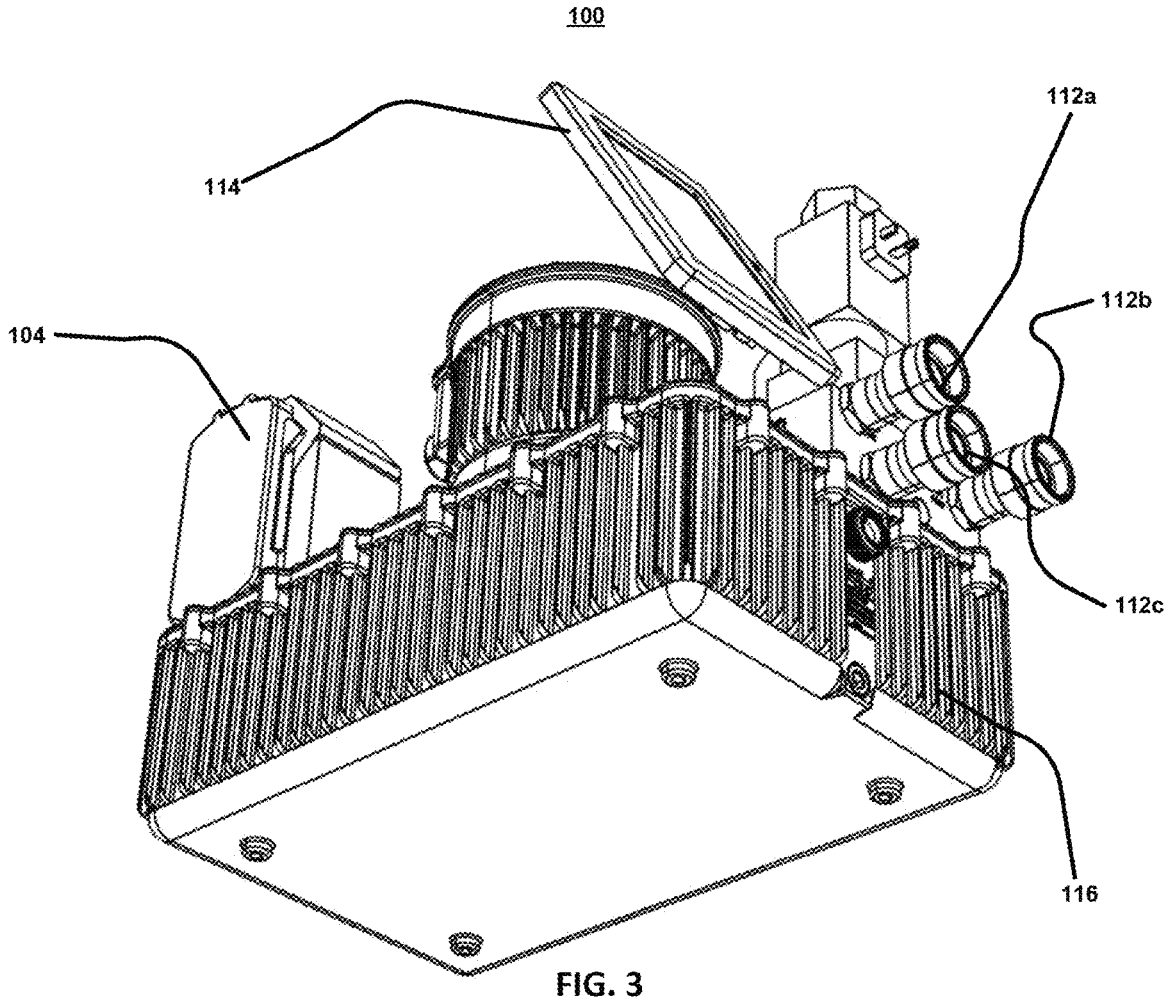
FIG. 3 is bottom perspective view of the pump unit according to exemplary embodiments.
Figure 4:
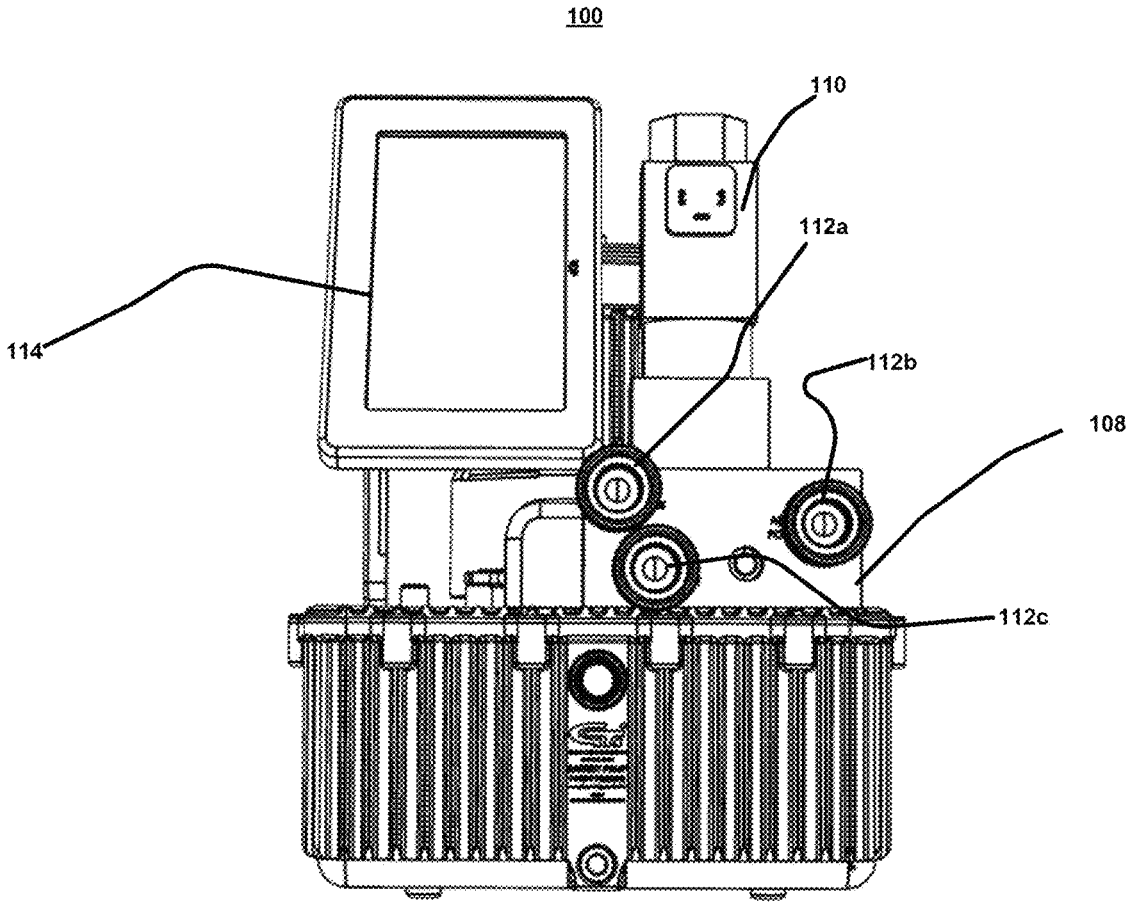
FIG. 4 is a front view of the pump unit according to exemplary embodiments.
Figure 5:
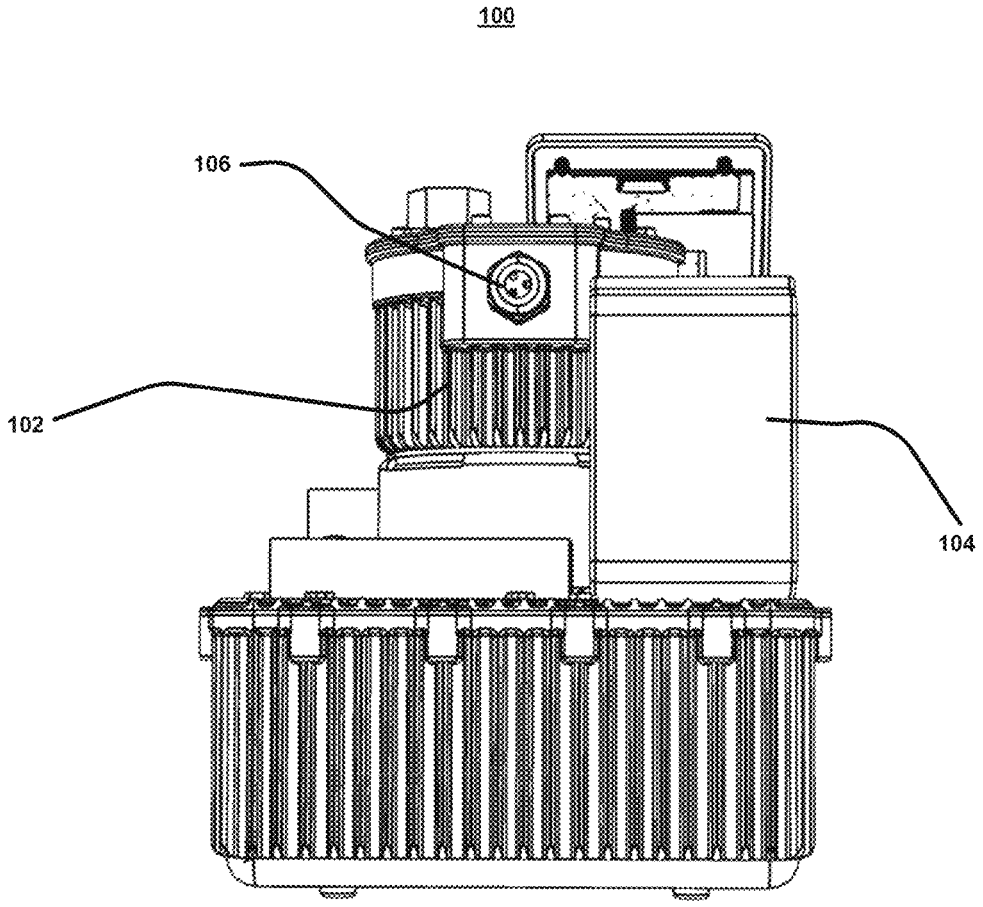
FIG. 5 is a rear view of the pump unit according to exemplary embodiments.

It is an object of the present invention to provide a hydraulic pump with integrated cooling that improves upon the prior art, such as depicted in FIGS. 1A and 1B. The heat exchanging system described herein provides for better and more efficient temperature control than existing systems. Moreover, according to embodiments of the present disclosure, the heat exchanging system may allow for use of a smaller hydraulic fluid reservoir. As a result, exemplary embodiments of the present disclosure can result in a smaller hydraulic pump which can be beneficial when in use in certain circumstances. For example, when used in conjunction with concrete bridges, elevation can become a major consideration, and smaller tools are less dangerous. Additionally, a smaller pump with less hydraulic fluid is necessarily lighter and easier to maneuver around a worksite.

In exemplary embodiments, the pump may be used for stressing of tendons for concrete tensioning (e.g., post-tensioning) through providing hydraulic power to a stressing jack or a shear for tendon tail cutting. In such usage, up to 8000 psi of tension may be required. By providing an integrated cooling system, the need for external cooling can be reduced or eliminated. In exemplary embodiments, the integrated cooling may be provided by a coil located proximal the hydraulic pump and reservoir. In certain embodiments the coil may be located under a fan which provides air cooling; the fan may be directly coupled to the pump motor. In certain embodiments, the coil may be located external to the pump unit such as located to the side of the pump unit with a fan collocated with the coil. The pump may be battery powered and may be portable. It should be appreciated that the coil provides for heat exchange between the hydraulic fluid and the surrounding atmosphere (i.e., surrounding air).

Referring to FIGS. 2 through 11, a pump unit 100 according to exemplary embodiments is shown from various views. The pump unit 100 is a hydraulic pump unit. The pump has an electric motor 102 to provide power. The motor may be a brushless motor. In exemplary embodiments, the motor is battery powered (for example, a battery pack 104 is depicted). Further, the pump unit can receive power from an external source (i.e., a connection to an electric power source) (through connection 106). In various embodiments, the pump unit may be capable of using different power sources such as a battery and external power, as shown, to provide added flexibility. The battery pack 104 is removable and may be rechargeable. In some embodiments, there may be more than one battery pack 104. The battery pack may include an electronics assembly for the pump unit.

The pump unit 100 has a hydraulic valve block 108 with a solenoid 110 for actuation. The hydraulic valve block 108 has ports 112*a*, 112*b*, 112*c*. Port 112*a* is the high pressure port (PS); 112*b* is the cylinder A(P) port, 112*c* is the cylinder B(R) port. The ports 112*a, b, c* each include releasable connections to allow for ease of attachment/detachment of external hoses. It should be appreciated that other port configurations are possible. Further, the various components of the pump unit may be detachable to allow for disassembly to facilitate repair and maintenance activities. In various embodiment, other types of port connections and configurations may be used based on the needs of the pump application.

Figure 6:
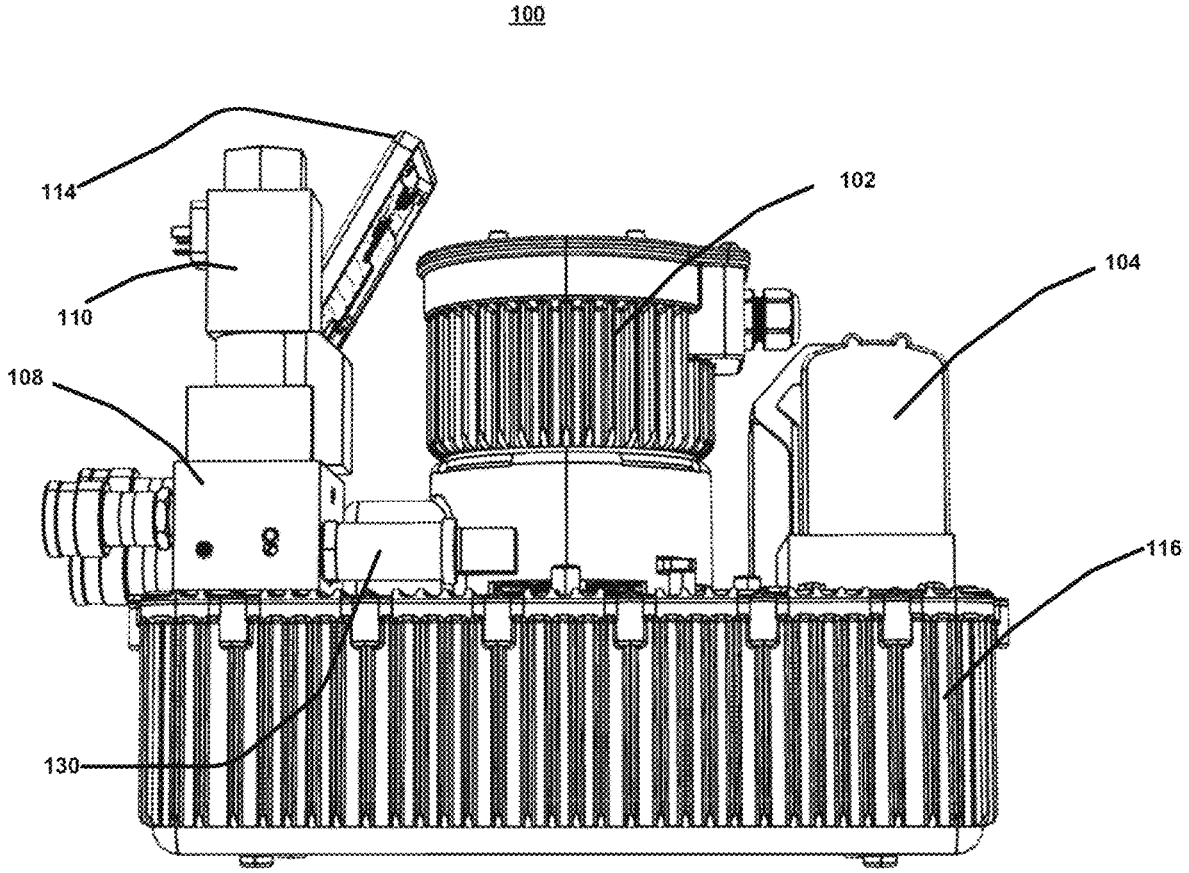
FIG. 6 is a side view of the pump unit according to exemplary embodiments.
Figure 7:
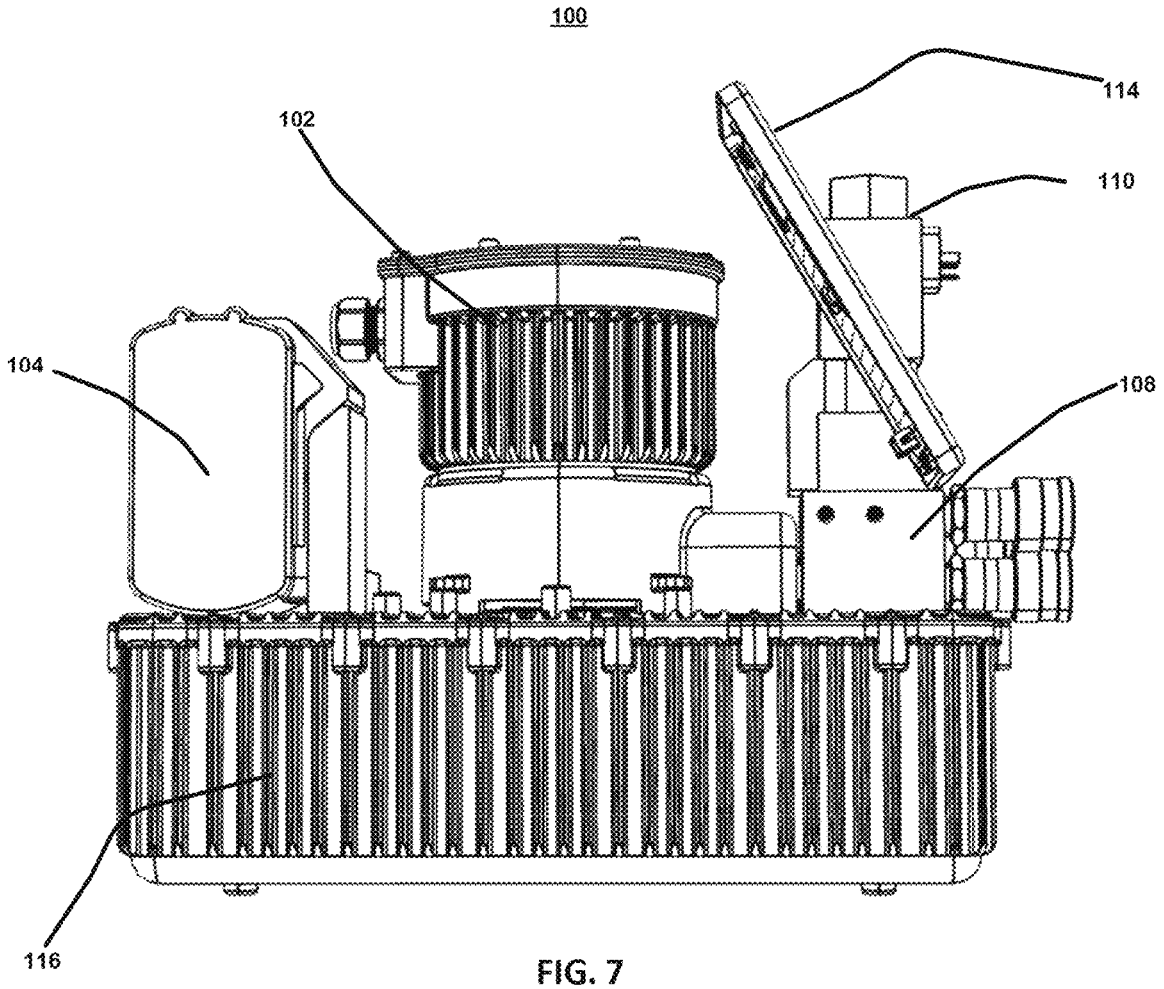
FIG. 7 is an opposite side view of the pump unit according to exemplary embodiments.

In exemplary embodiments, the pump has a display 114 that is touch capable to provide for operational input, as well as display of pump status and system operating parameters (e.g., temperature, pressure, battery status, etc.). The display may be digital and may be of any suitable screen type such as LED. Memory storage may be provided to allow for data on usage and operations to be stored and later retrieved. In various embodiments, the pump unit 100 may have a wireless connection (e.g., WIFI and/or Bluetooth) to enable remote control and/or monitoring of the pump operation from a computing device such as, but not limited to, a laptop, a tablet, and/or smartphone. In various embodiments, the display 114 may be movable between different positions to allow for lowering the display for transport as well as positioning to allow for a certain viewing angle when in use. A pressure sensor 130 is mounted to the valve block 108 as best shown in FIG. 6. The pressure sensor may be communicatively coupled with the display 114 and/or other external monitoring devices as described above. In various embodiments, the pressure sensor may contain other sensors, such as a temperature sensor.

Figure 11:
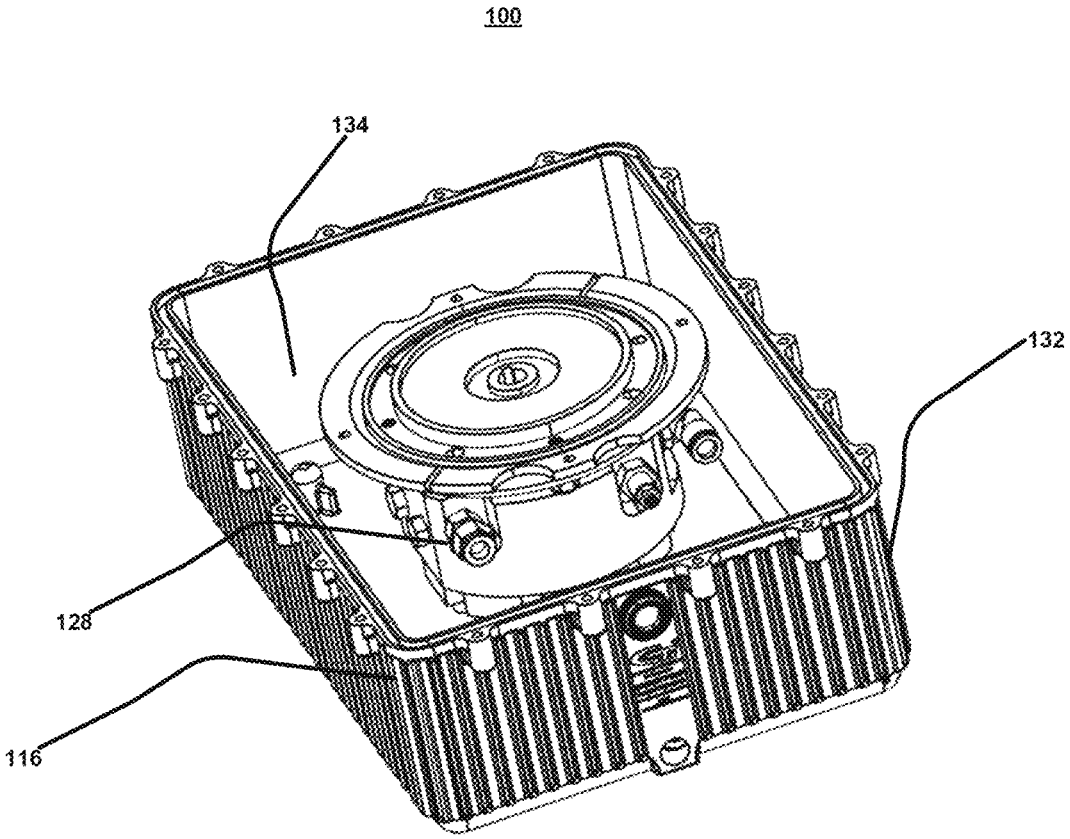
FIG. 11 is a top perspective view of the interior of the lower section of the pump unit according to exemplary embodiments.

The lower section 116 contains a pump 128 (e.g., a TX 1101 pump) within its internal volume 134 (as shown in FIG. 11, for example). The pump may be any suitable pump for the application (i.e., hydraulic power). For example, the pump may be a piston pump. Other types of pumps (e.g., gear, vane) may be used. The lower section 116 may be a single cast pan. The lower section 116 may include fins 132 on its exterior surface to assist with heat exchange. The various components can be seen from different views in the figures. The internal volume 134 of the lower section 116 serves as a hydraulic fluid reservoir (as can be seen in FIG. 11, for example). The pump 128 may be mounted to the underside of the top cover 115 of the lower section 116.

Figure 8:
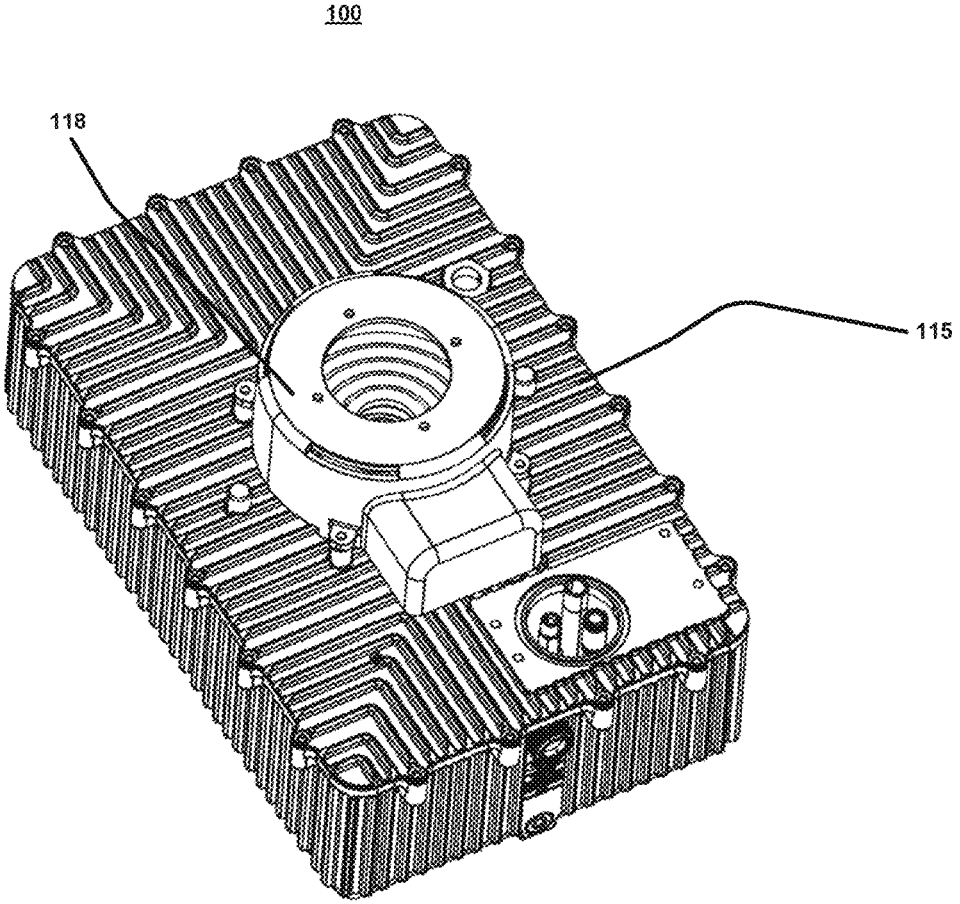
FIG. 8 is a perspective view of the pump unit with components removed to illustrate the cowling for the cooling coil according to exemplary embodiments.
Figure 9:
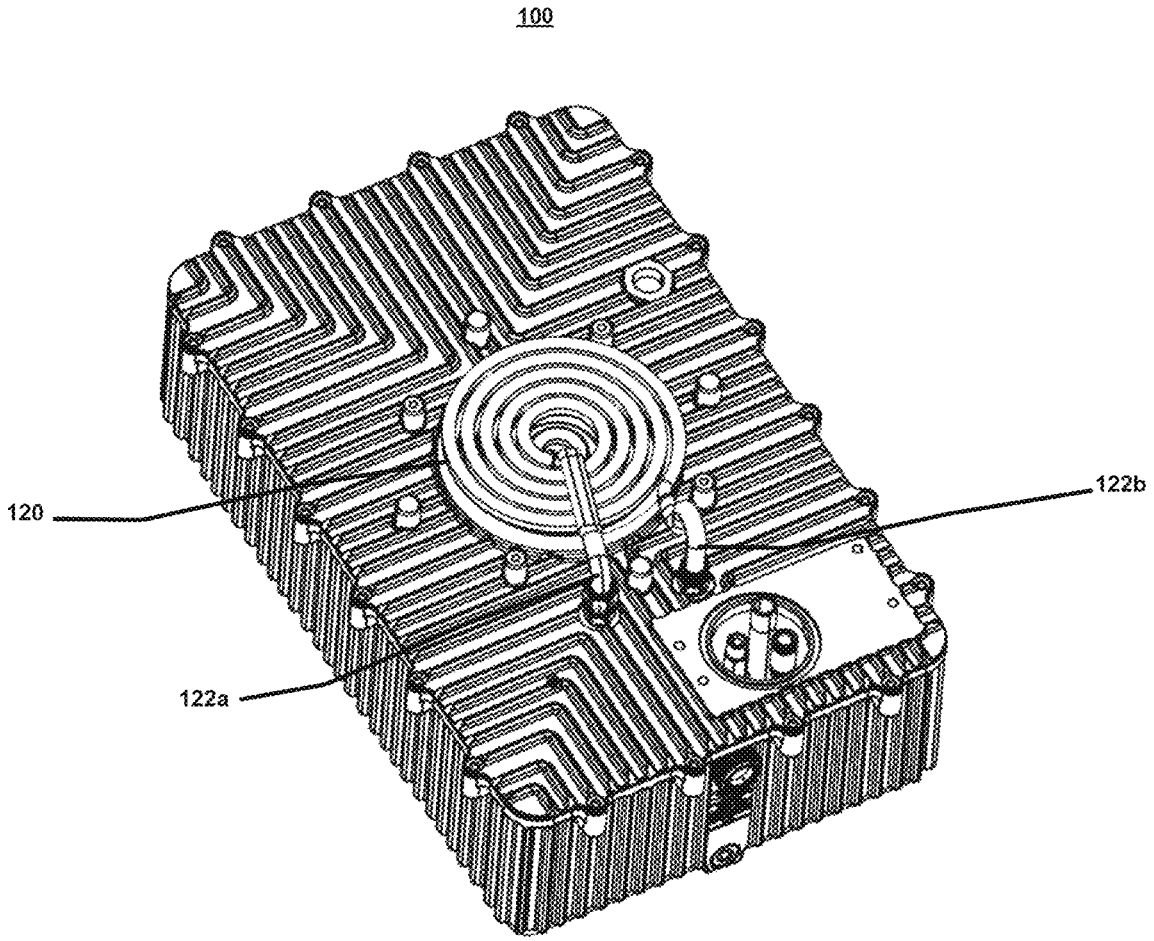
FIG. 9 is a perspective view of the pump unit with components removed to illustrate the cooling coil according to exemplary embodiments.

In exemplary embodiments, the pump unit 100 includes an integrated cooling system. Below the motor 102 is a cowling 118 as can be seen in FIG. 8, for example. Also, in FIG. 8, the top cover 115 of the lower section 116 can be seen. Contained within and covered by the cowling 118 is a coil 120 for cooling (i.e., heat exchange with the atmosphere), as can be seen in FIG. 9. The coil may be spiral wound. The coil has terminations 122*a* and 122*b*, that are co-located and that are in fluid communication with the pump 128 and/or valve block 108 to allow fluid to enter and leave the coil to be cooled. The coil may serve as a heat exchanger. The coil may also be referred to as a cooling coil.

Figure 10:
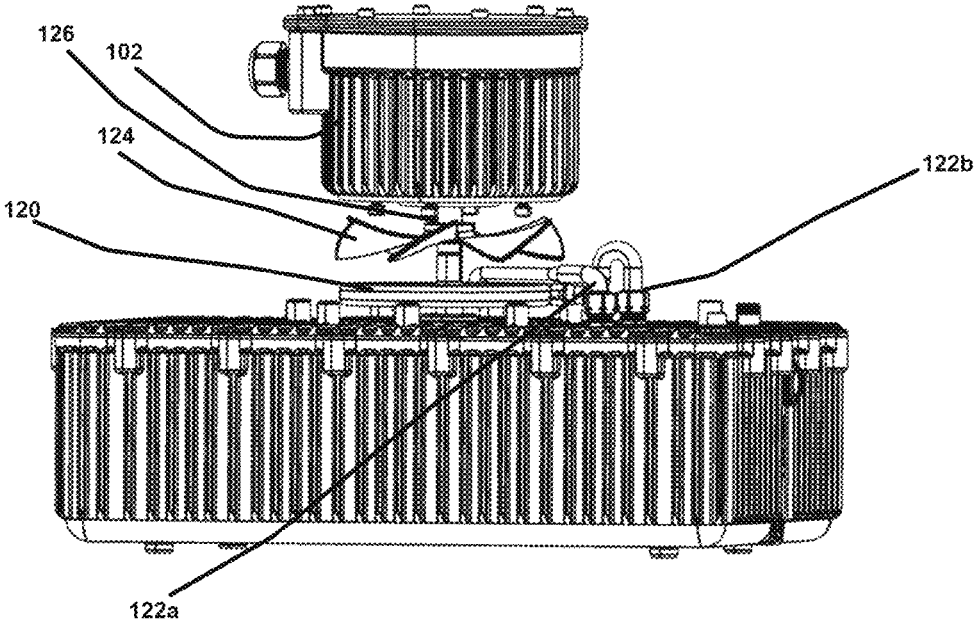
FIG. 10 is a side view of the pump unit with components removed to illustrate the cooling coil and fan according to exemplary embodiments.

As shown in FIG. 10, a fan 124 is located above and over the coil 120 and contained within the cowling 118. The fan 124 is attached to the drive shaft 126 of the motor 102. The fan provides air flow to facilitate heat exchange with the fluid in the coils. In various embodiments, the cowling 118 may have vents and/or louvers to facilitate air exchange with the outside atmosphere to improve the heat exchange. The fan 124 may accomplish this by either pulling air or pushing air through the coil 120, based on fan blade spin direction and/or fan installation orientation.

As can be seen in FIG. 11, the pump 128 is centrally located in the internal volume 134 the lower section 116. The pump is located directly below the cooling coil in the pan. The shaft 126 of the motor drive the pump. As can be seen the pump has intake and exhaust ports that are in fluid communication with the valve block 108 and/or the coil 120.

Referring to FIGS. 12 through 18, a pump unit 200 according to exemplary embodiments is shown from various views. The pump unit 200 is a hydraulic pump unit and may be similar to the pump unit 100 described above. The pump has an electric motor 202 to provide power. The motor may be a brushless motor. The motor is battery powered (for example, a battery pack having two batteries 204*a* and 204*b* is depicted). In some embodiments the pump unit may receive power from an external source (i.e., a connection to an electric power source). In various embodiments, the pump unit may be capable of using different power sources such as a battery and external power, as shown, to provide added flexibility. The batteries 204*a* and 204*b* may be removable and may be rechargeable. Located between the batteries may be an electronics assembly 206

The pump unit 200 has a hydraulic valve block 208 with a solenoid 210 for actuation. The hydraulic valve block 208 includes a valve assembly and a sensor assembly. The sensor assembly may include a temperate and pressure sensor. The ports include releasable connections to allow for ease of attachment/detachment of external hoses. The port connections on the solenoid may be standard hydraulic connections. It should be appreciated that the port connections depicted are exemplary and other port configurations are possible. Further, the various components of the pump unit may be detachable to allow for disassembly to facilitate repair and maintenance activities. The pump unit 200 may have a flow meter assembly 212. The ports of the solenoid 210 are exemplary and can be in any configuration suitable to support the operation of the pump unit 200.

Figure 12:
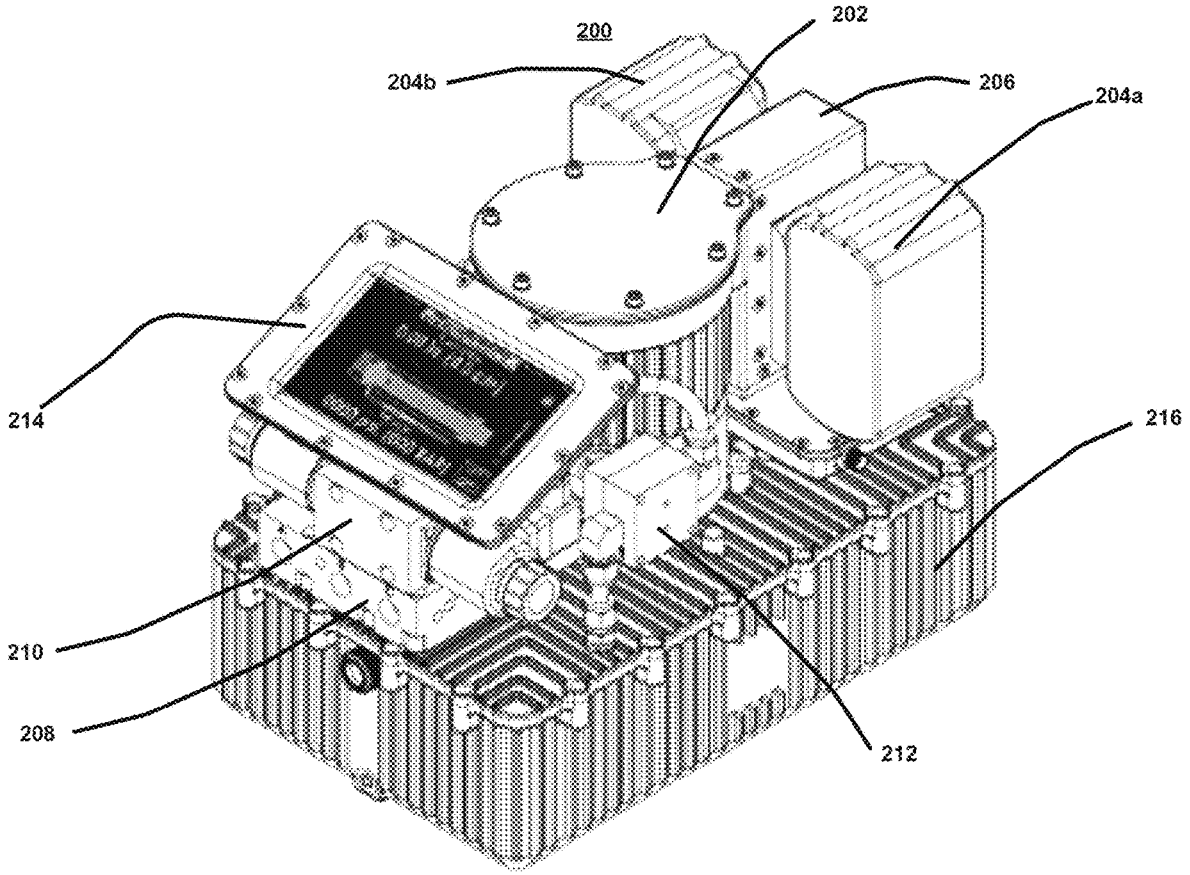
FIG. 12 is a side perspective view of a second pump unit according to exemplary embodiments with a display in the lowered position.
Figure 13:
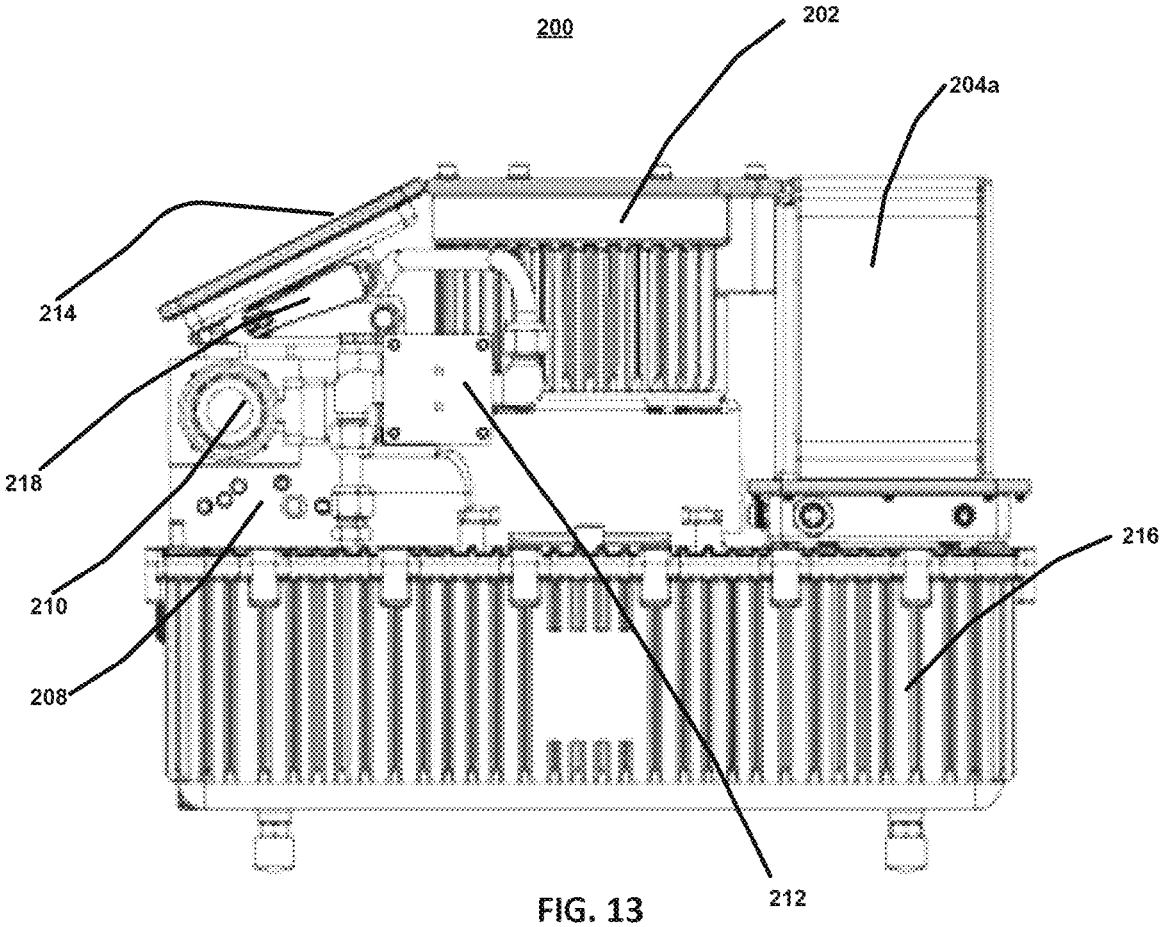
FIG. 13 is a side view of the second pump unit according to exemplary embodiments with a display in the lowered position.
Figure 14:
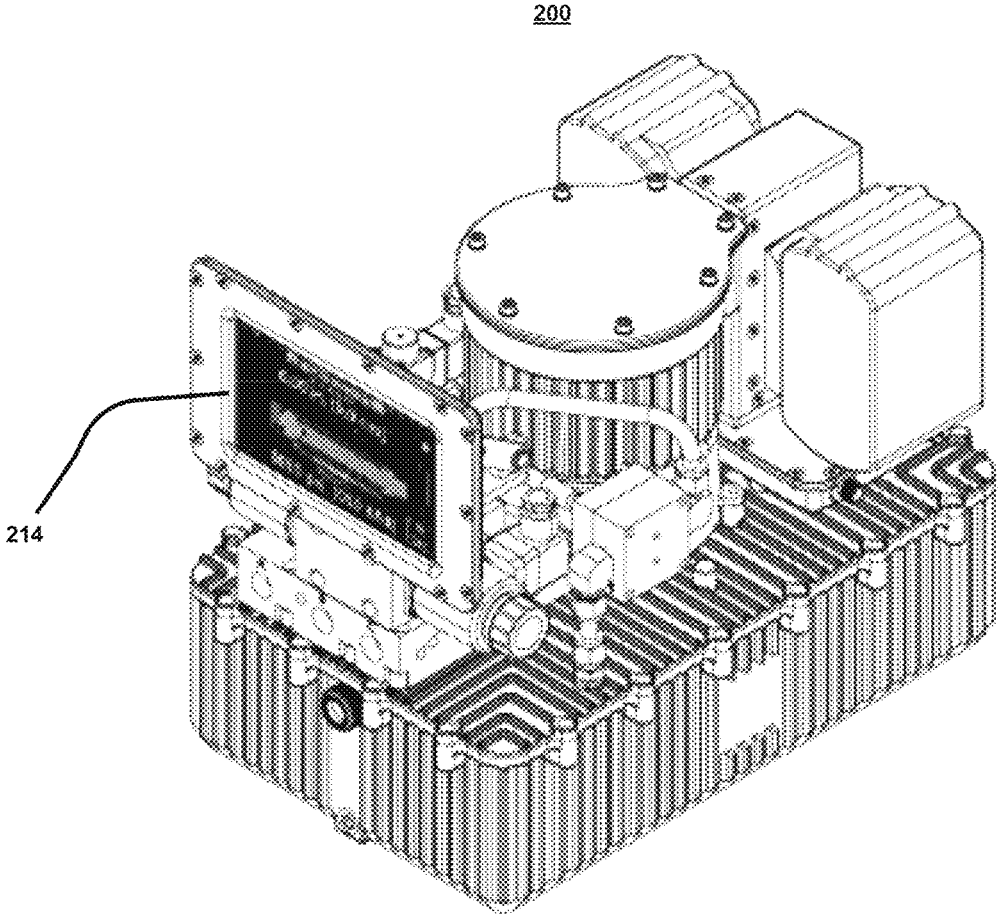
FIG. 14 is a side perspective view of the second pump unit according to exemplary embodiments with a display in the raised position.
Figure 15:
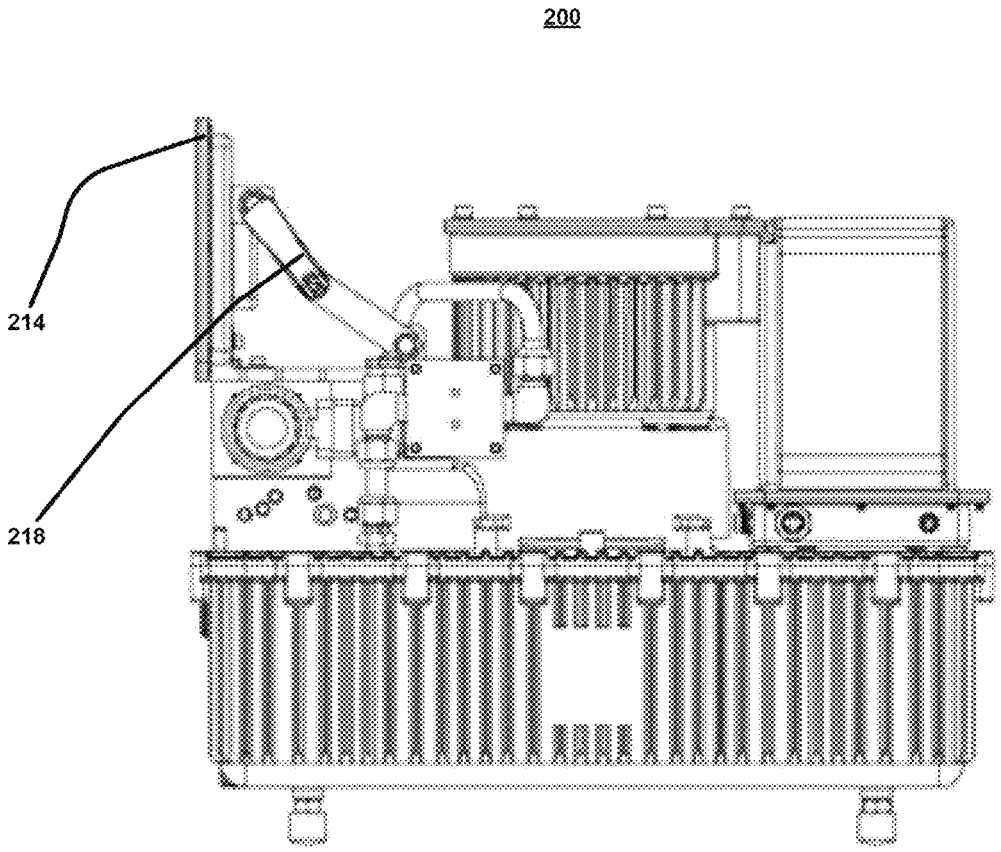
FIG. 15 is a side view of the second pump unit according to exemplary embodiments with a display in the raised position.

In exemplary embodiments, the pump has a display 214 that is touch capable to provide for operational input, as well as display of pump status and system operating parameters (e.g., temperature, pressure, battery status, etc.). The display may be digital and may be of any suitable screen type such as LED. Memory storage may be provided to allow for data on usage and operations to be stored and later retrieved. In various embodiments, the pump unit 200 may have a wireless connection (e.g., WIFI and/or Bluetooth) to enable remote control and/or monitoring of the pump operation from a computing device such as, but not limited to, a laptop, a tablet, and/or smartphone. In various embodiments, the display 214 is movable between different positions to allow for lowering the display for transport as well as positioning to allow for a certain viewing angle when in use. For example, FIGS. 12 and 13 depicts the display 214 in a lowered position and FIGS. 14 and 15 depict the display 214 in a raised position. An arm assembly 218 is attached to the display 214 to provide support. As can be seen in FIGS. 13 and 15, the arm assembly 218 may be articulated with at least one joint to facilitate movement of the display 214.

The lower section 216 has a top cover assembly 238. Mounted to the lower side of the top cover assembly 238 is a pump 220 (e.g., a TX 1101 pump). The pump 220 is contained within the internal volume 222 of the lower section 216. The pump may be any suitable pump for the application (i.e., hydraulic power). In exemplary embodiments, the pump 220 is mounted to the top cover assembly as shown. For example, the pump may be a piston pump. Other types of pumps (e.g., gear, vane) may be used. The lower section 216 may be a single cast pan. The lower section 216 can include fins 232 on its exterior surface to assist with heat exchange. The internal volume 222 serves as a hydraulic fluid reservoir.

Figure 16:
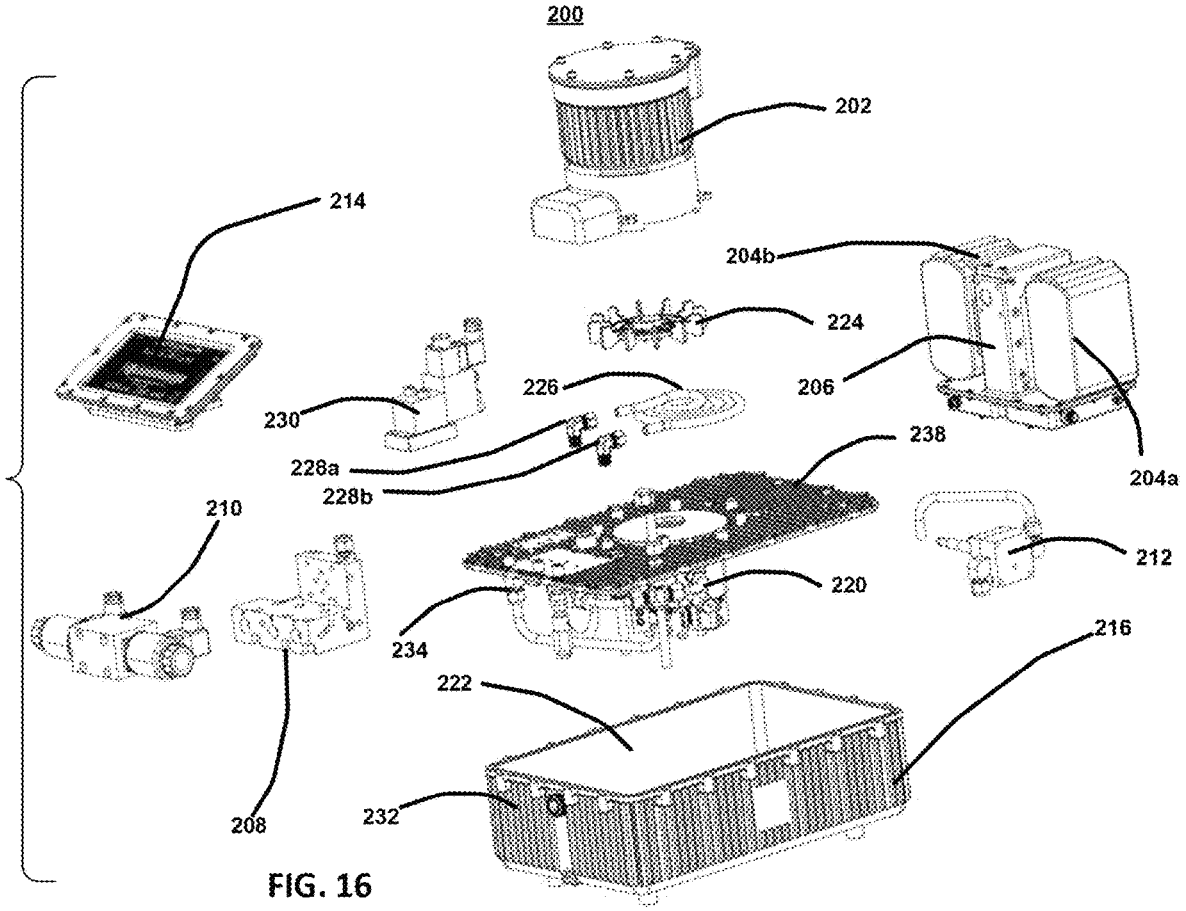
FIG. 16 is an exploded view of the second pump unit according to exemplary embodiments.
Figure 17:
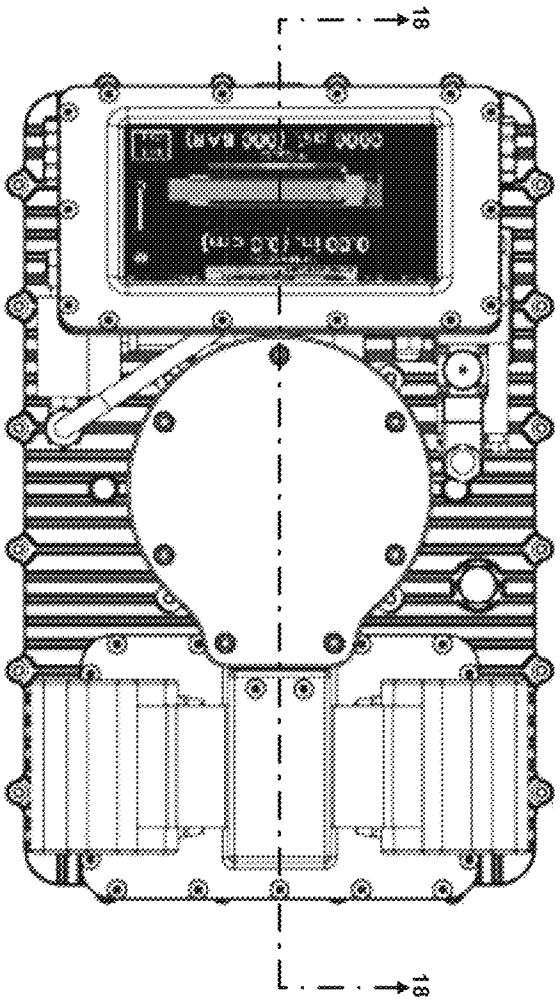
FIG. 17 is a top view of the second pump unit according to exemplary embodiments.

In exemplary embodiments, the pump unit 200 includes an integrated cooling system. Below the motor 202 is a fan 224 and below the fan 224 is a coil 226 for cooling of the hydraulic fluid. The cooling may be achieved through heat exchange with the atmosphere. The coil 226 may be spiral wound. The coil may have terminations 228*a* and 228*b*, that are co-located and that are in fluid communication with the pump 220 and/or solenoid 210 to allow fluid to enter and leave the coil to be cooled. The coil may serve as a heat exchanger. The coil may also be referred to as a cooling coil or spiral cooler. The pump unit 200 may also include a proportional valve 230. As can be seen in FIG. 16, for example, there is tubing 234 which serve to connect the valve block 208 to the pump 220.

Figure 18:
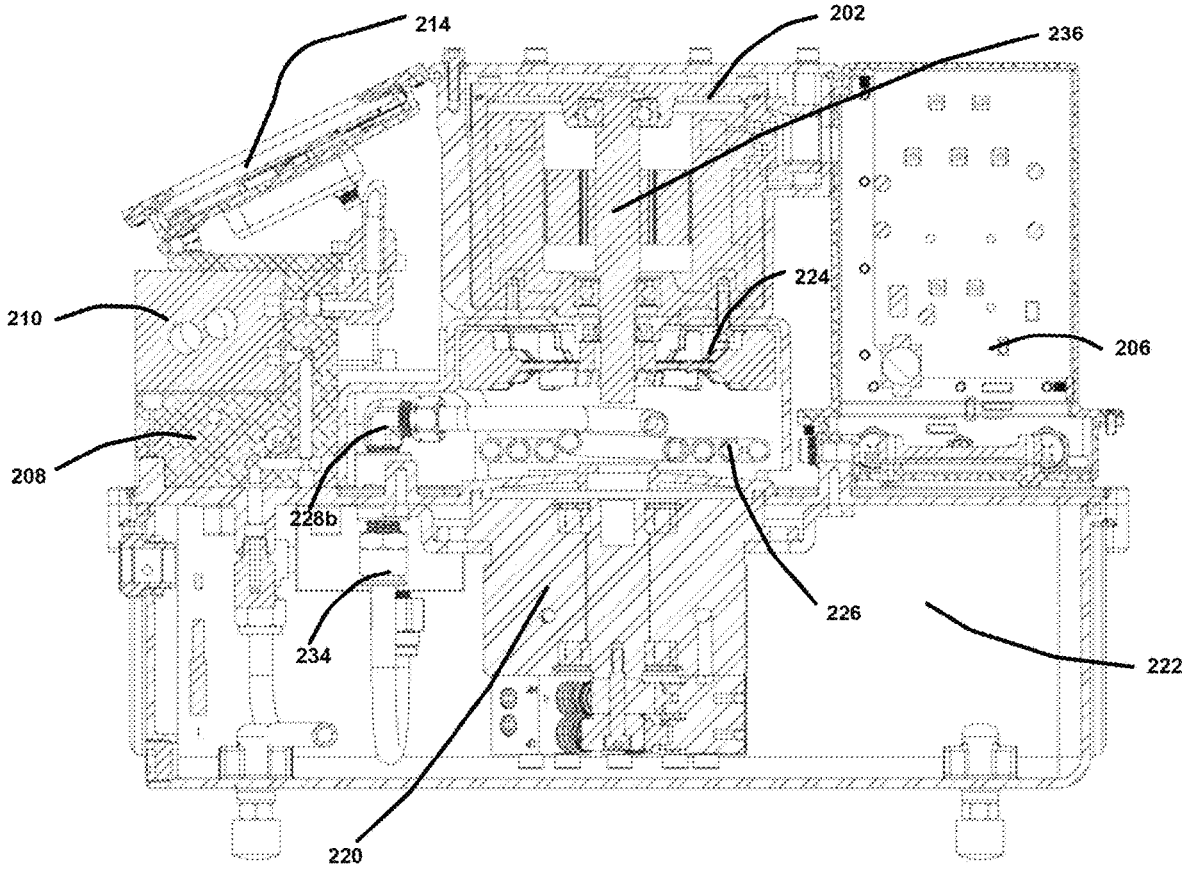
FIG. 18 is a sectional view of the second pump unit according to exemplary embodiments.
Figure 19:
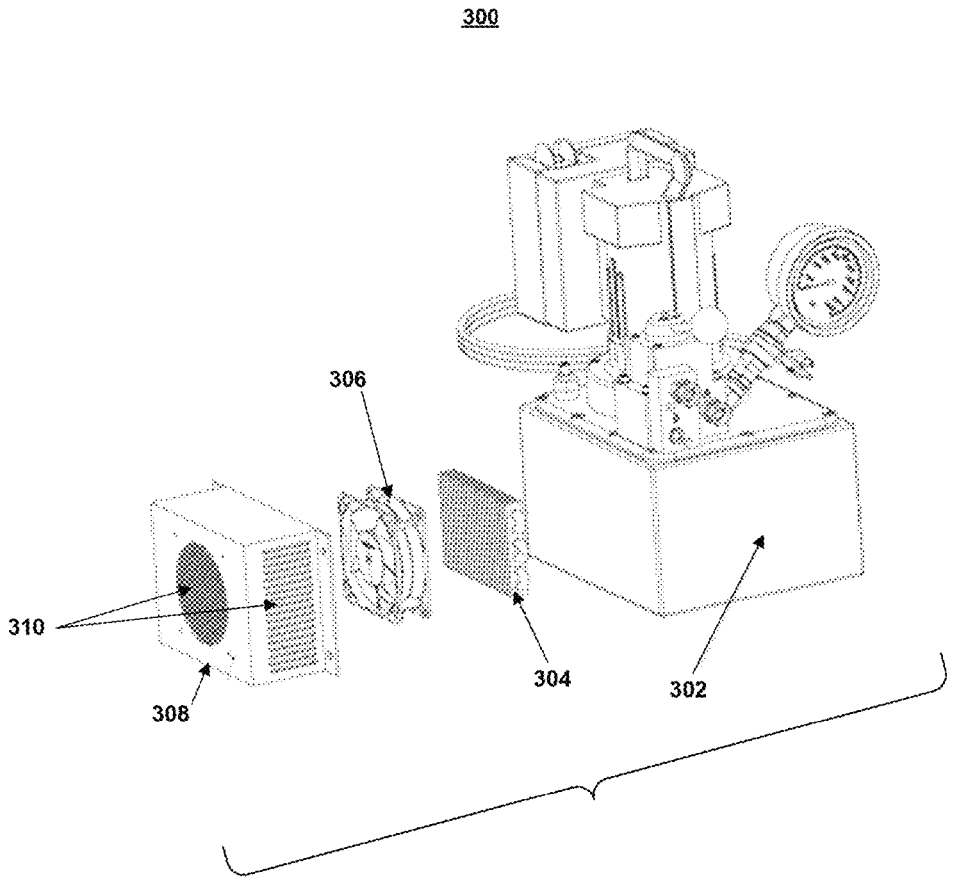
FIG. 19 shows an exemplary exploded view of a third pump unit according to exemplary embodiments.
Figure 20:
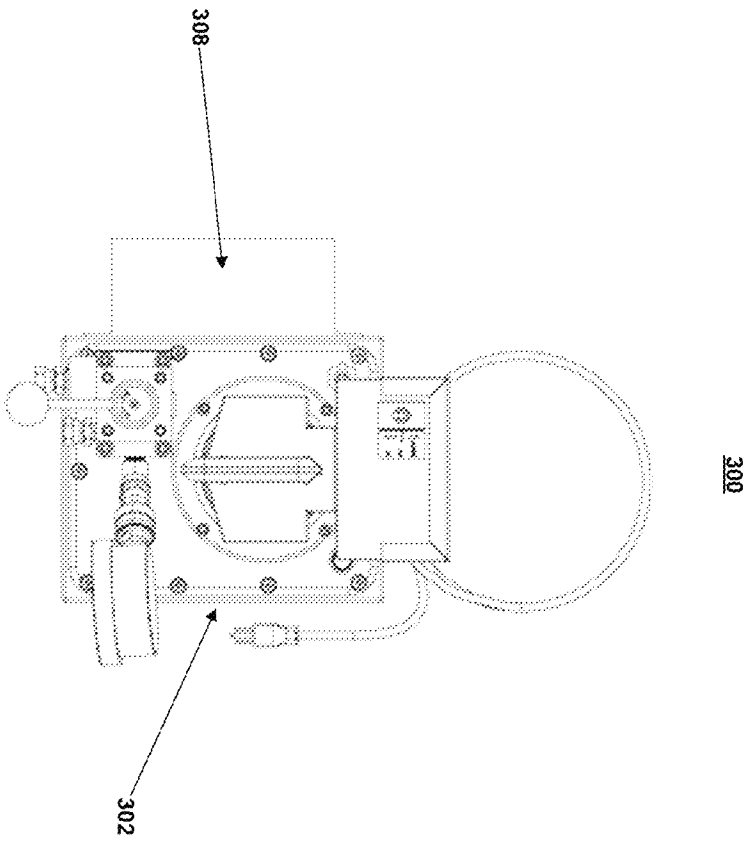
FIG. 20 shows a top view of the third pump unit according to exemplary embodiments.
Figure 21:
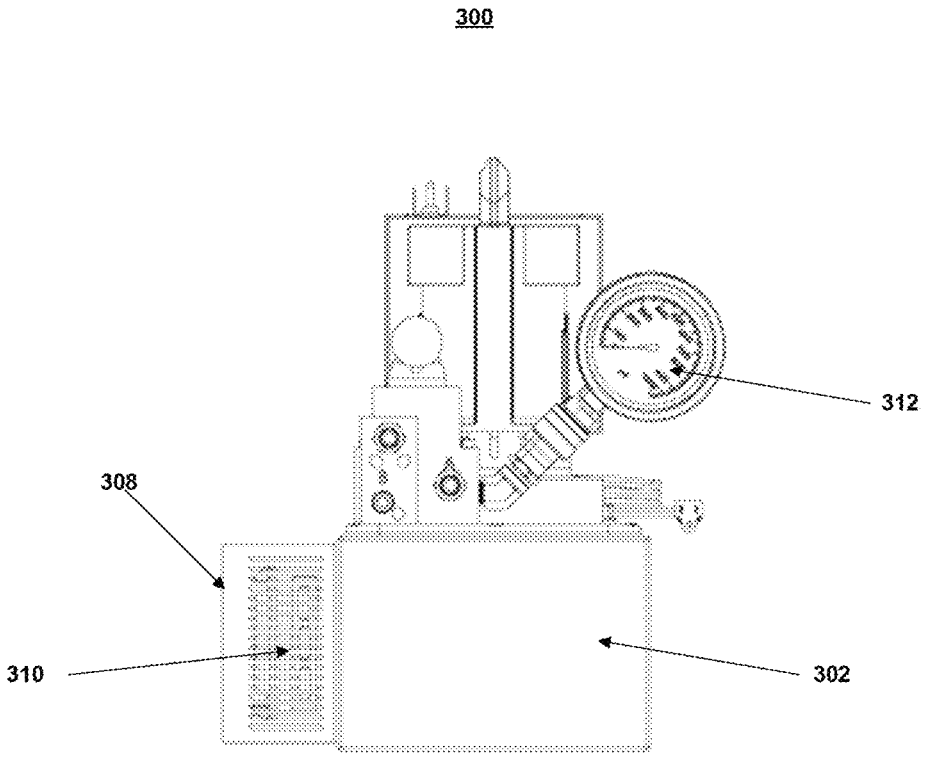
FIG. 21 shows a front view of the third pump unit according to exemplary embodiments.
Figure 22:
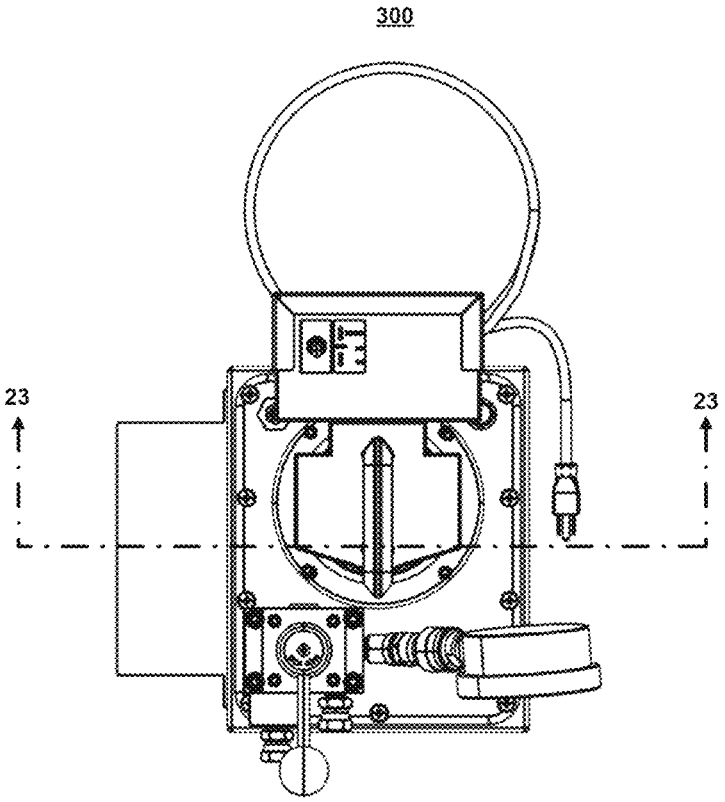
FIG. 22 shows a top view of the third pump unit according to exemplary embodiments.
Figure 23:
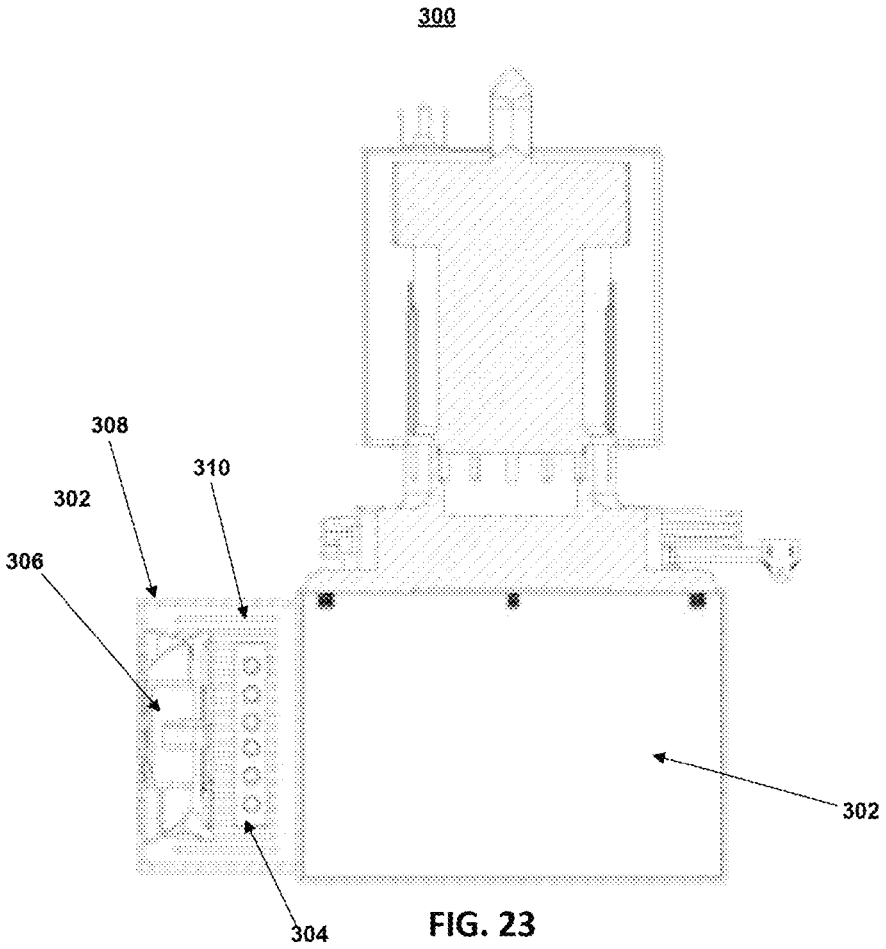
FIG. 23 shows a sectional view of the third pump unit according to exemplary embodiments.

The fan 224 is located above and over the coil 226. The fan 224 is attached to a drive shaft 236 of the motor 202 (as can be seen in FIG. 18, for example). The fan provides air flow to facilitate heat exchange with the fluid in the coil. The fan 224 may accomplish this by either pulling air or pushing air through the coil 226, based on fan blade spin direction and/or fan installation orientation.

Another exemplary embodiment may be seen in FIGS. 19-23. The pump unit 300 may be a similar hydraulic pump unit to the pump units 100 and 200 as described above. The pump unit 300 includes a hydraulic pump 302 that includes, amongst other parts, a reservoir, a motor, a power cord, a hydraulic valve block, a solenoid, an operating mechanism, and a pump. In various embodiments, the pump 302 may be an industry standard pump. The pump unit 300 includes an air to liquid heat exchanger or cooling coil unit. The heat exchanger may be located/mounted on a side of the hydraulic pump, in the exemplary embodiment, the heat exchanger may be on the left side. An electric fan 306 is positioned near the heat exchanger and forces air through the fins of the heat exchanger or cooling coil unit 304. The fan may accomplish this by either pulling air or pushing air through the heat exchanger, based on fan blade spin direction and/or fan installation orientation.

The cooling coil unit 304 may have connections for hoses to connect it into the hydraulic fluid loop. In some embodiments, the cooling coil unit may be directly connected into the hydraulic fluid reservoir of the hydraulic pump 302.

A housing 308 is installed over the heat exchanger and fan to protect them from damage due to impacts at the worksite, in transportation, etc. The housing 308 is attached via fasteners to the pump unit. For example, four fasteners may be used positioned on the corners of the housing 308. The fasteners may be any suitable type such as rivets, screws, bolts, etc. The housing 308 has sufficient venting 310 to allow for efficient operation of the fan and thereby optimal heat transfer out of the hydraulic fluid and into the ambient air. For example, exemplary embodiments of the housing may include vents, louvers, etc. in one or more side surfaces that may allow for ingestion of ambient air when the fan is configured to push air through the heat exchanger. In this scenario, the heat exchanger may be mounted to the pump body with sufficient clearance to allow for air to easily pass through the heat exchanger. In yet other embodiments, there may be vents in the face of the housing, as illustrated. These vents may be in addition to or in place of the vents in the sides of the housing. In scenarios where the fan is configured to pull air through the heat exchanger, that air may then exhaust through the vents in the housing. In order to ensure sufficient air flow through the heat exchanger, it may be installed onto the pump body with standoffs or other means to create sufficient clearance between the pump body and heat exchanger for unrestricted air flow through the heat exchanger.

The pump unit has a hydraulic valve with a solenoid. The valve depicted is exemplary and other valves may be used. The pump unit 300 has a analog gauge for pressure 312. In some embodiments, this may be replaced with a digital display that is touch capable to provide for operational input, as well as display of pump status and system operating parameters (e.g., temperature, pressure, battery status, etc.). Memory storage may be provided to allow for data on usage and operations to be stored and later retrieved. In various embodiments, the pump unit may have a wireless connection (e.g., WIFI and/or Bluetooth) to enable remote control and/or monitoring of the pump operation from a computing device such as, but not limited to, a laptop, a tablet, and/or smartphone.

Although embodiments of the present invention have been described herein in the context of a particular implementation in a particular environment for a particular purpose, those skilled in the art will recognize that its usefulness is not limited thereto and that the embodiments of the present invention can be beneficially implemented in other related environments for similar purposes. The invention should therefore not be limited by the above described embodiments, method, and examples, but by all embodiments within the scope and spirit of the invention as claimed.

Further, it is to be understood that the terminology used herein is for the purpose of describing particular embodiments only and is not intended to be limiting. The terms "a" or "an" as used herein, are defined as one or more than one.

In the invention, various embodiments have been described with references to the accompanying drawings. It may, however, be evident that various modifications and changes may be made thereto, and additional embodiments may be implemented, without departing from the broader scope of the invention as set forth in the claims that follow. The invention and drawings are accordingly to be regarded in an illustrative rather than restrictive sense.

What is claimed is:

1. A hydraulic pump unit, comprising:

a hydraulic pump;

a fan;

an electric motor mechanically coupled via a shaft to the fan and to the hydraulic pump to provide power to the fan and the hydraulic pump with the electric motor being located vertically above the fan which is in turn located vertically above the hydraulic pump; and a cooling coil configured to allow for hydraulic fluid to flow through and heat exchange with surrounding atmosphere, the cooling coil being physically located between the fan and the hydraulic pump and being coiled in a horizontal plane with the shaft running through a center of the cooling coil.

2. The hydraulic pump unit of claim 1, further comprising:

a hydraulic valve block controlled by a solenoid, the hydraulic valve block being fluidly coupled with the hydraulic pump and to a plurality of external hydraulic fluid connections to allow for flow of hydraulic fluid.

3. The hydraulic pump unit of claim 2, wherein the plurality of external hydraulic fluid connections are fluidly coupled to a device configured for tensioning tendons for concrete post-tensioning operations.

4. The hydraulic pump unit of claim 1, further comprising:

a detachable battery pack providing power to the electric motor.

5. The hydraulic pump unit of claim 1, wherein the hydraulic pump unit is configured to be portable.

6. The hydraulic pump unit of claim 1 further comprising:

a display screen for display of operating parameters of the hydraulic pump, comprising at least pressure.

7. A hydraulic pump unit, comprising:

a hydraulic pump;

a fan;

an electric motor mechanically coupled via a shaft to the fan and to the hydraulic pump to provide power to the fan and the hydraulic pump, wherein the electric motor is located in a vertical plane over the fan and hydraulic pump with the electric motor being located vertically above the fan which is in turn located vertically above the hydraulic pump; and a cooling coil located directly beneath the fan and over the hydraulic pump and that is fluidly coupled to the hydraulic pump to allow for hydraulic fluid to flow through and heat exchange with surrounding air and the cooling coil being coiled in a horizontal plane surround the shaft with the shaft running through a center of the cooling coil.

8. The hydraulic pump unit of claim 7, further comprising:

a hydraulic valve block controlled by a solenoid, the hydraulic valve block being fluidly coupled with the hydraulic pump and to a plurality of external hydraulic fluid connections to allow for flow of hydraulic fluid.

9. The hydraulic pump unit of claim 8, wherein the plurality of external hydraulic fluid connections are fluidly coupled to a device configured for tensioning tendons for concrete post-tensioning operations.

10. The hydraulic pump unit of claim 7, further comprising:

a detachable battery pack providing power to the electric motor.

11. The hydraulic pump unit of claim 10, wherein the hydraulic pump unit is configured to be portable.

12. The hydraulic pump unit of claim 7, further comprising:

a display screen for display of operating parameters of hydraulic pump, comprising at least pressure.

* * * * *